US009935372B2

(12) United States Patent
Yamaguchi et al.

(10) Patent No.: US 9,935,372 B2
(45) Date of Patent: Apr. 3, 2018

(54) INTEGRATED ANTENNA, AND MANUFACTURING METHOD THEREOF

(71) Applicant: FUJIKURA LTD., Tokyo (JP)

(72) Inventors: Yuichiro Yamaguchi, Sakura (JP); Hiroshi Chiba, Tokyo (JP); Hiroiku Tayama, Sakura (JP); Ning Guan, Sakura (JP)

(73) Assignee: FUJIKURA LTD., Tokyo (JP)

( * ) Notice: Subject to any disclaimer, the term of this patent is extended or adjusted under 35 U.S.C. 154(b) by 31 days.

(21) Appl. No.: 14/766,838

(22) PCT Filed: Feb. 28, 2014

(86) PCT No.: PCT/JP2014/055146
§ 371 (c)(1),
(2) Date: Aug. 10, 2015

(87) PCT Pub. No.: WO2014/133155
PCT Pub. Date: Sep. 4, 2014

(65) Prior Publication Data

US 2016/0013554 A1 Jan. 14, 2016

(30) Foreign Application Priority Data

Mar. 1, 2013 (JP) ..... 2013-041254

(51) Int. Cl.
*H01Q 7/00* (2006.01)
*H01Q 21/28* (2006.01)
(Continued)

(52) U.S. Cl.
CPC ..... *H01Q 7/00* (2013.01); *H01Q 1/3275* (2013.01); *H01Q 1/52* (2013.01); *H01Q 5/385* (2015.01);
(Continued)

(58) Field of Classification Search
CPC ..... H01Q 7/00; H01Q 7/005; H01Q 7/02; H01Q 7/04; H01Q 7/06; H01Q 7/08; H01Q 5/385; H01Q 9/265
See application file for complete search history.

(56) References Cited

U.S. PATENT DOCUMENTS 5,198,826 A * 3/1993 Ito ..... H01Q 7/00 343/713
8,056,819 B2 * 11/2011 Rowell ..... G01R 33/34007 235/487
(Continued)

FOREIGN PATENT DOCUMENTS

CN 1665068 A 9/2005
CN 101855780 A 10/2010
(Continued)

OTHER PUBLICATIONS

Extended European Search Report dated Jan. 11, 2016, issued in counterpart European Patent Application No. 14757477.6. (8 pages).
(Continued)

*Primary Examiner* — Daniel J Munoz
(74) *Attorney, Agent, or Firm* — Westerman, Hattori, Daniels & Adrian, LLP

(57) ABSTRACT

An integrated antenna (1) includes: a first loop antenna (11) having a first annular antenna element (11*a*); and a second loop antenna (13) having a second annular antenna element (13). The second annular antenna element (13) is arranged, on a surface identical to that where the first annular antenna element (13*a*) is arranged, so as to surround the first annular antenna element (13*a*).

7 Claims, 9 Drawing Sheets

(51) Int. Cl.

| | |
|---|---|
| ***H01Q 1/32*** | (2006.01) |
| ***H01Q 5/00*** | (2015.01) |
| ***H01Q 1/52*** | (2006.01) |
| ***H01Q 21/06*** | (2006.01) |
| ***H01Q 21/30*** | (2006.01) |
| ***H01Q 5/385*** | (2015.01) |
| ***H01Q 21/00*** | (2006.01) |

(52) U.S. Cl.
CPC ..... *H01Q 21/0087* (2013.01); *H01Q 21/06* (2013.01); *H01Q 21/28* (2013.01); *H01Q 21/30* (2013.01)

(56) References Cited

U.S. PATENT DOCUMENTS

| | | | | |
|---|---|---|---|---|
| 2004/0217907 | A1* | 11/2004 | Inoue | H01Q 1/38 343/728 |
| 2005/0052334 | A1* | 3/2005 | Ogino | H01Q 1/1271 343/866 |
| 2005/0190112 | A1 | 9/2005 | Thudor et al. | |
| 2007/0120756 | A1* | 5/2007 | Ogino | H01Q 1/1271 343/713 |
| 2007/0182658 | A1 | 8/2007 | Ozden | |
| 2008/0055171 | A1 | 3/2008 | Noro et al. | |
| 2010/0231468 | A1 | 9/2010 | Ogino et al. | |
| 2013/0002513 | A1* | 1/2013 | Dokai | H01Q 1/2208 343/867 |

FOREIGN PATENT DOCUMENTS

| | | | |
|---|---|---|---|
| EP | 1 742 296 | A1 | 1/2007 |
| JP | 11-8511 | A | 1/1999 |
| JP | 2005-347798 | A | 12/2005 |
| JP | 2009-118268 | A | 5/2009 |
| JP | 2011-71936 | A | 4/2011 |
| JP | 2011-101412 | A | 5/2011 |
| KR | 10-0652229 | B1 | 11/2006 |
| WO | 2013/094692 | A1 | 6/2013 |

OTHER PUBLICATIONS

Office Action dated Sep. 27, 2016, issued in Chinese Patent Application No. 201480007378.2. (8 pages).
Decision to grant a patent dated Aug. 9, 2016, issued in Japanese Patent Application No. 2015-503059 (3 pages).
International Search Report dated May 20, 2014, issued in counterpart application No. PCT/JP2014/055146 (1 page).
Office Action dated Apr. 12, 2016, issued in counterpart Japanese Patent Application No. 2015-503059, with full English translation. (6 pages).

* cited by examiner

INTEGRATED ANTENNA, AND MANUFACTURING METHOD THEREOF

TECHNICAL FIELD

The present invention relates to an integrated antenna into which a plurality of antennas are integrated. Specifically, the present invention relates to an integrated antenna into which at least two loop antennas are integrated. Further, the present invention relates to a method of manufacturing an integrated antenna.

BACKGROUND ART

In accordance with expansion of use application of wireless communications, an antenna which operates in various frequency bands has been desired. For example, as an on-vehicle antenna mounted on a vehicle such as a car, an antenna has been desired which operates in frequency bands of FM/AM broadcasting, SDARS (Satellite Digital Audio Radio Service), DAB (Digital Audio Broadcast), DTV (Digital Television), GPS (Global Positioning System), VICS (registered trademark) (Vehicle Information and Communication System), ETC (Electronic Toll Collection), and the like.

Conventionally, antennas which operate in respective different frequency bands have been often realized as individual antennas. For example, an antenna for FM/AM broadcasting has been realized as a whip antenna which is mounted on a rooftop, whereas an antenna for digital terrestrial broadcasting has been realized as a film antenna which is attached to a windshield.

However, a car has a limited space where an antenna device can be mounted. Furthermore, in a case where the number of antenna devices to be mounted on a car is increased, this causes problems such that a design of the car is spoiled or costs to mount the antenna devices are increased. In order to avoid such problems, it is effective to use an integrated antenna. Note here that an integrated antenna indicates an antenna device including a plurality of antennas which operate in respective different frequency bands.

As such an integrated antenna, for example, there is known an integrated antenna disclosed in Patent Literature 1. The integrated antenna disclosed in Patent Literature 1 is an integrated antenna into which an SDARS antenna and a GPS antenna are integrated. The integrated antenna disclosed in Patent Literature 1 employs a configuration such that the SDARS antenna and the GPS antenna, each of which is configured as a flat-panel antenna, are arranged side by side on an antenna base.

CITATION LIST

Patent Literature

[Patent Literature 1]
The specification of U.S. patent application publication, No. 2008/0055171

SUMMARY OF INVENTION

Technical Problem

An integrated antenna into which at least two loop antennas are integrated has had the following problems.

That is, in a case where the loop antennas are arranged side by side on the basis of the integrated antenna disclosed in Patent Literature 1, there has been a problem that the integrated antenna is inevitably increased in size in a horizontal direction of the integrated antenna.

On the other hand, in a case where the loop antennas are arranged one above the other (in a case where the loop antennas are layered), there has been a problem that the integrated antenna is inevitably increased in size in a vertical direction of the integrated antenna. Moreover, in a case where two antennas, e.g., an SDARS antenna and a GPS antenna, are layered which receives respective electromagnetic waves coming from an identical direction (in this case, zenith direction), there has had concern that a characteristic of one of the antennas, which one is provided on a lower side, is deteriorated. This is because part of the electromagnetic wave which should be received by such a lower antenna is blocked by such an upper antenna.

The present invention has been made in view of the above problems, and an object of the present invention is to realize a small-sized integrated antenna into which at least two loop antennas are integrated, without causing a deterioration in characteristic of each of the loop antennas.

Solution to Problem

In order to attain the above object, an integrated antenna in accordance with the present invention includes: a first loop antenna having a first annular antenna element; and a second loop antenna having a second annular antenna element, the second loop antenna being lower in resonance frequency than the first loop antenna, the second annular antenna element being arranged, on an surface identical to that where the first annular antenna element is arranged, so as to surround the first annular antenna element.

Advantageous Effects of Invention

According to the present invention, it is possible to realize an integrated antenna which is smaller in size than a conventional integrated antenna, without causing a deterioration in characteristic of each loop antenna.

Figure 2:
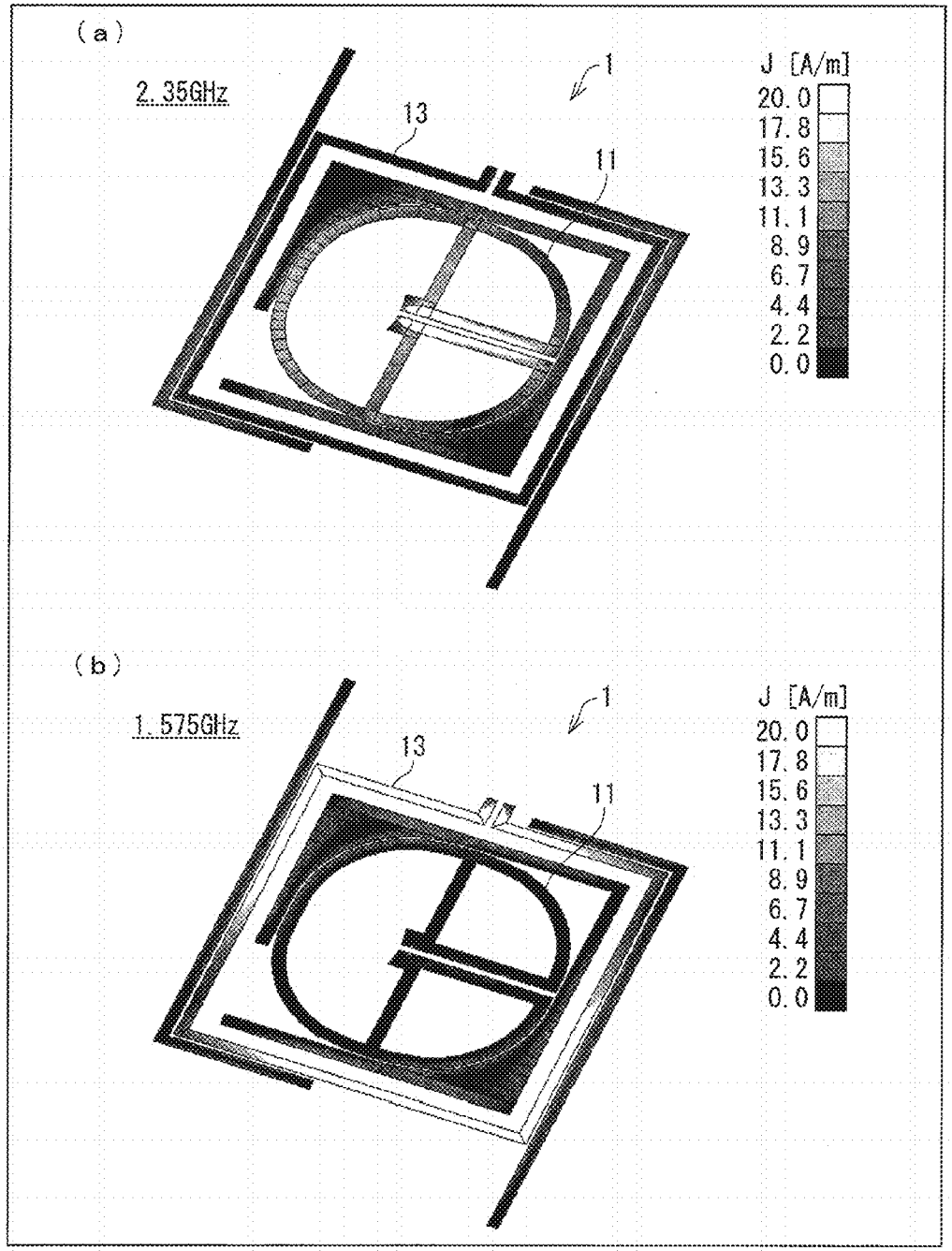

(a) of FIG. 2 is a perspective view illustrating current distribution (simulation result) formed in a case where a high-frequency current of 2.35 GHz is applied to a first loop antenna. (b) of FIG. 2 is a perspective view illustrating current distribution (simulation result) formed in a case where a high-frequency current of 1.575 GHz is applied to a second loop antenna.

Figure 3:
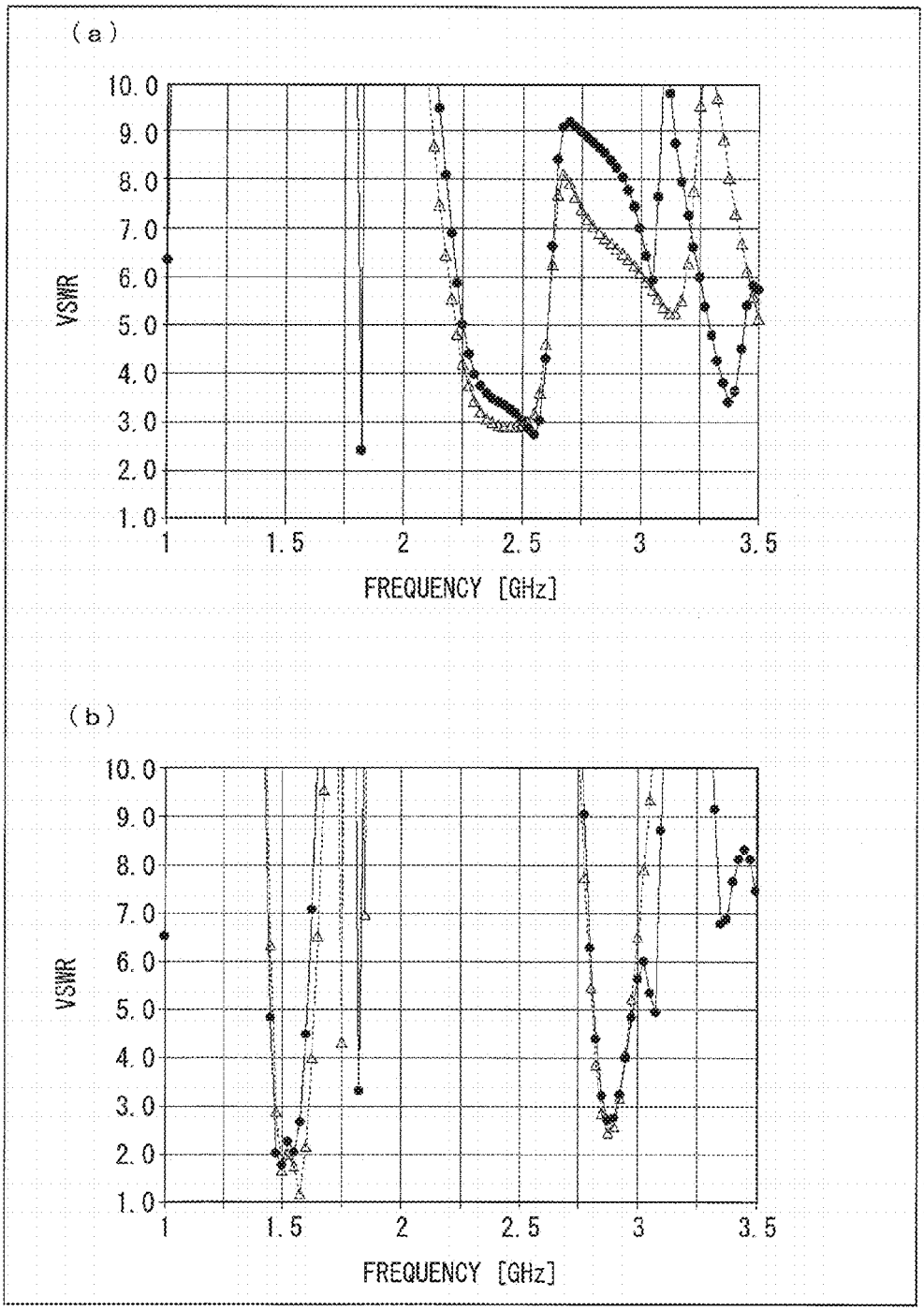

(a) of FIG. 3 is a graph illustrating a VSWR characteristic (simulation result) of the first loop antenna. (b) of FIG. 3 is a graph illustrating a VSWR characteristic (simulation result) of the second loop antenna.

Figure 4:
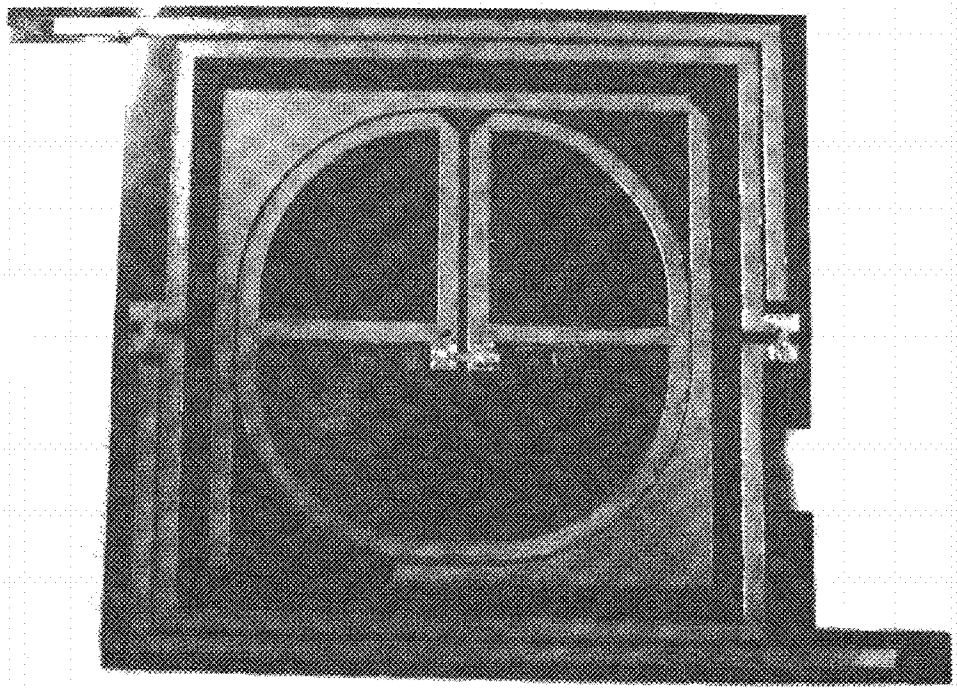

FIG. 4 is a picture of an integrated antenna used in an experiment.

Figure 5:
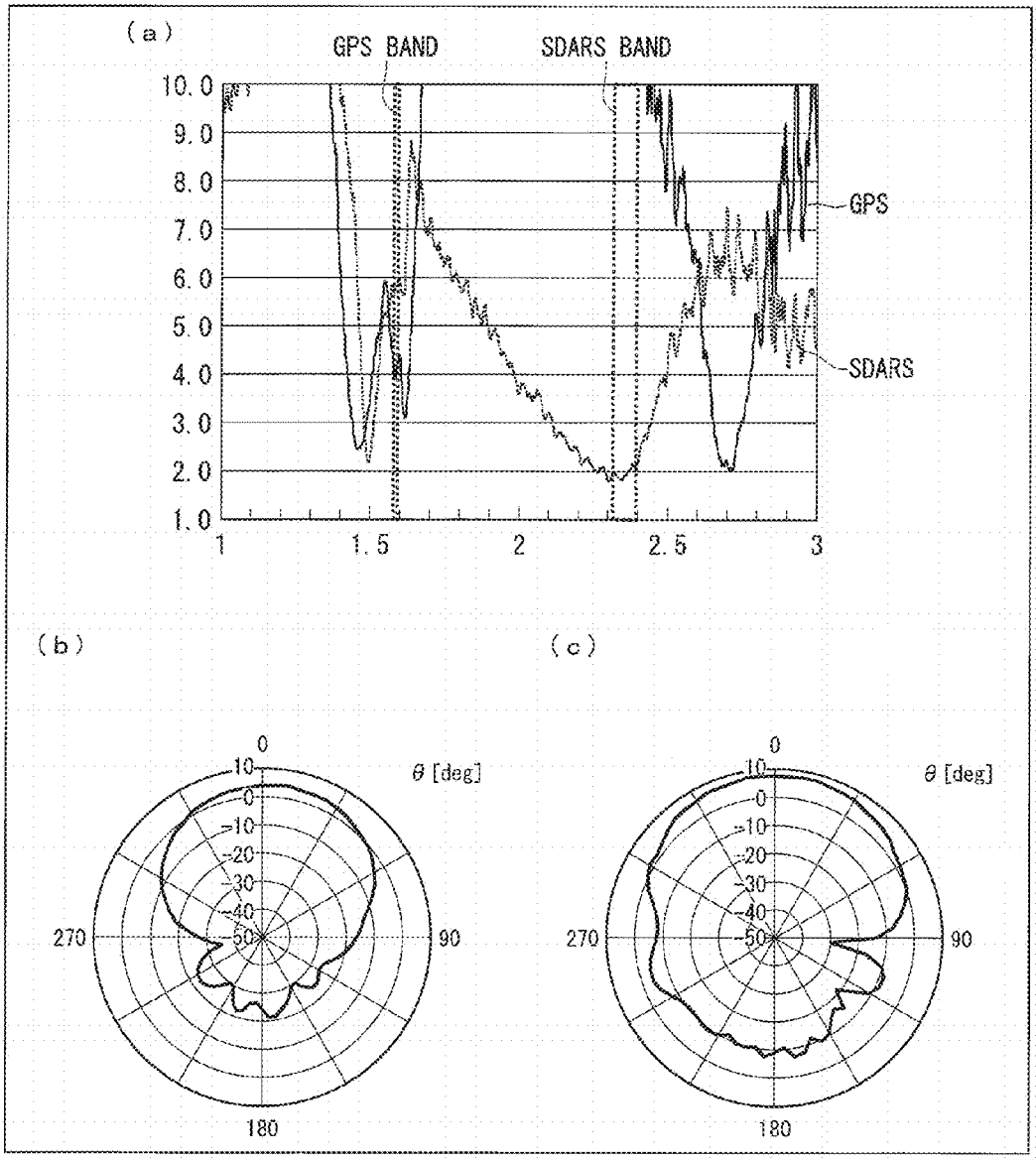

(a) of FIG. 5 is a graph illustrating (i) a VSWR characteristic (experimental result) of a first loop antenna and (ii) a VSWR characteristic (experimental result) of a second loop antenna. (b) of FIG. 5 is a graph illustrating a radiation pattern (directional dependence of radiant gain of a circularly polarized wave) of the second loop antenna. (c) of FIG.

5 is a graph illustrating a radiation pattern (directional dependence of radiant gain of a circularly polarized wave) of the first loop antenna.

Figure 6:
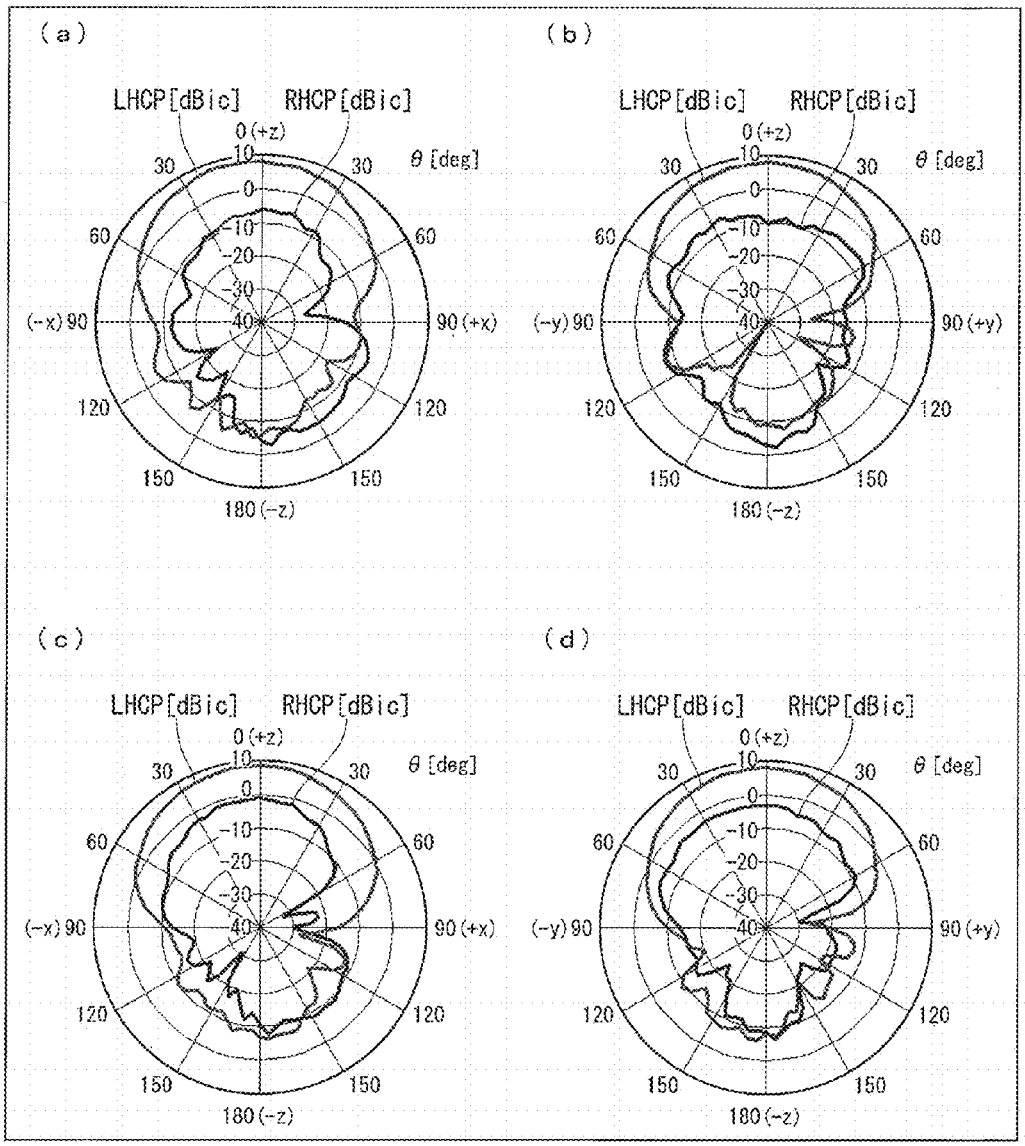

FIG. 6 is a graph illustrating a radiation pattern of the first loop antenna (directional dependence of radiant gain of a right-handed circularly polarized wave and directional dependence of radiant gain of a left-handed circularly polarized wave). (a) and (b) of FIG. 6 each illustrate the radiation pattern (Example) in a state where the first loop antenna is integrated with the second loop antenna. (c) and (d) of FIG. 6 each illustrate the radiation pattern (Comparative Example) in a state where the first loop antenna is not integrated with the second loop antenna. Note that (a) and (c) of FIG. 6 each illustrate a radiation pattern on a yz plane, whereas (b) and (d) of FIG. 6 each illustrate a radiation pattern on a zx plane.

Figure 7:
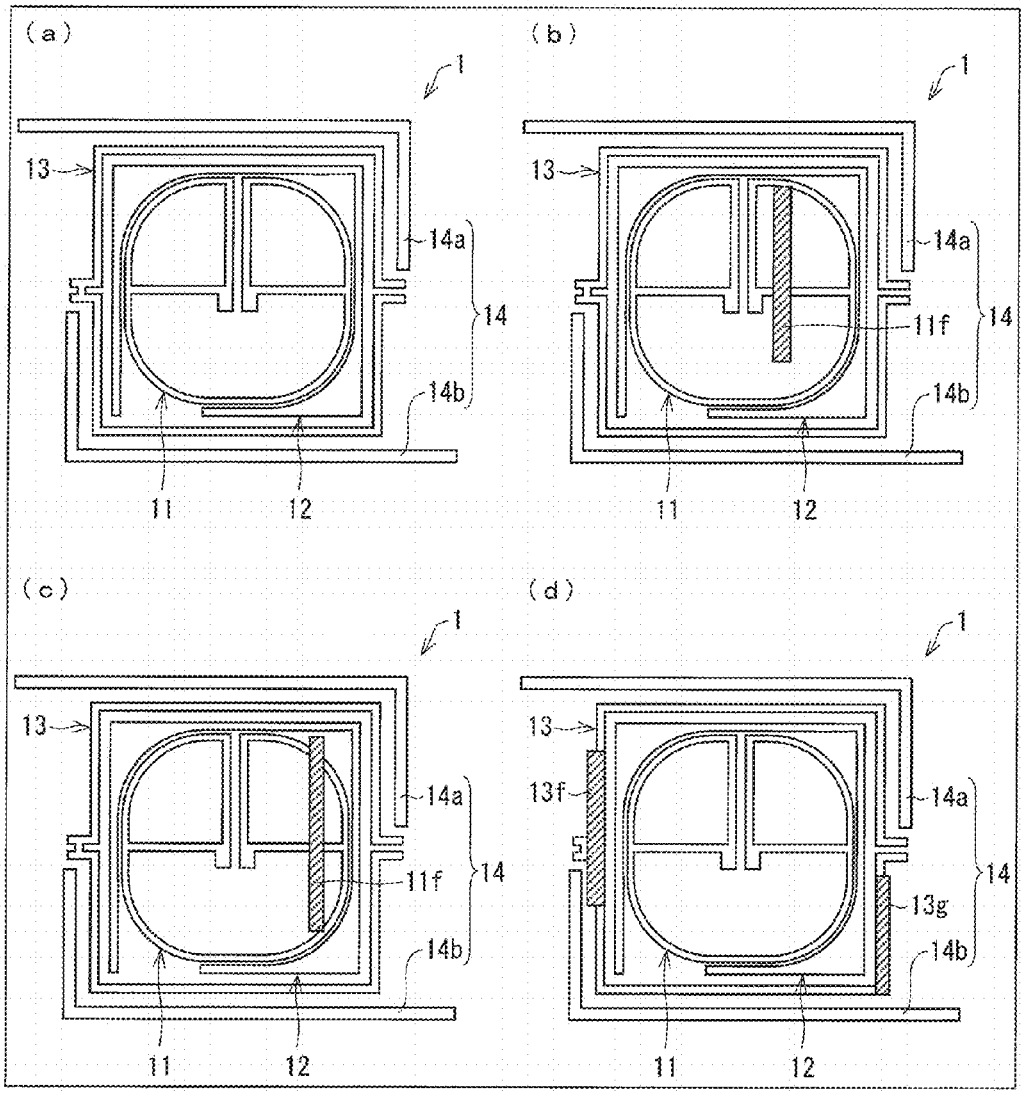

FIG. 7 is a plan view illustrating a configuration of an integrated antenna in accordance with Example of the present invention. (a) of FIG. 7 illustrates the configuration of the integrated antenna in which no change was made. (b) of FIG. 7 illustrates the configuration of the integrated antenna in which a shape, on an inner circumference side, of a first loop antenna was changed. (c) of FIG. 7 illustrates the configuration of the integrated antenna in which the shape, on the inner circumference side and an outer circumference side, of the first loop antenna was changed. (d) of FIG. 7 illustrates the configuration of the integrated antenna in which a shape, on an outer circumference side, of an second loop antenna was changed.

Figure 8:
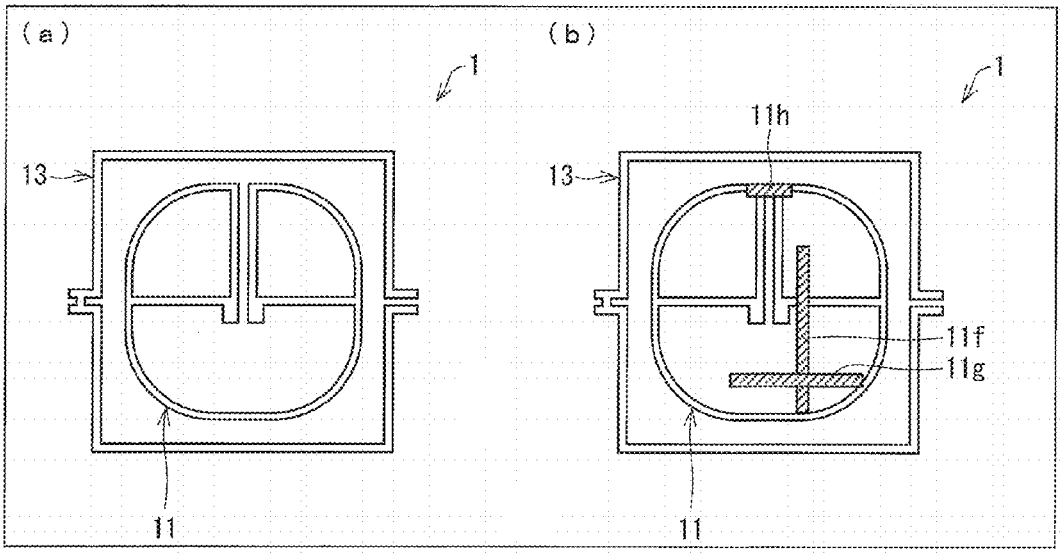

FIG. 8 is a plan view illustrating a configuration of an integrated antenna in accordance with Example of the present invention. (a) of FIG. 8 illustrates the configuration of the integrated antenna in which no change was made. (b) of FIG. 8 illustrates the configuration of the integrated antenna in which a shape, on an inner circumference side, of a first loop antenna was changed.

Figure 9:
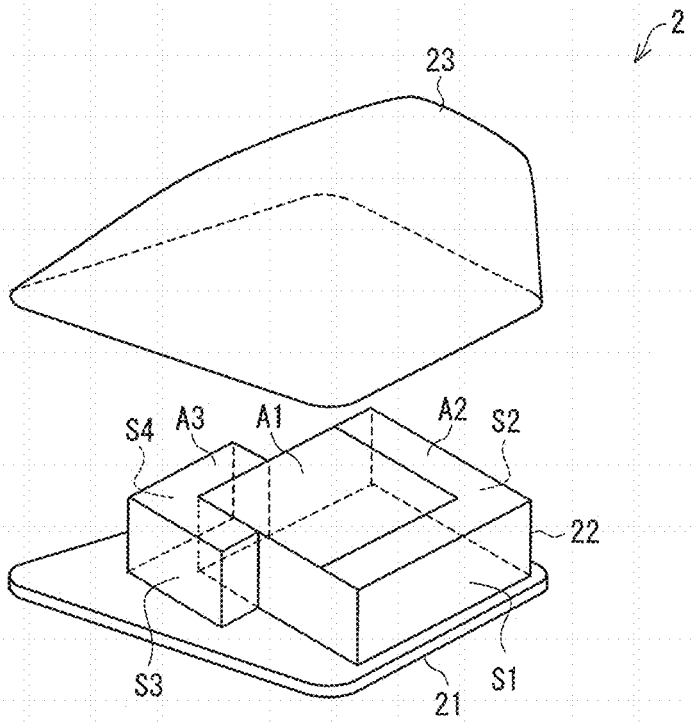

FIG. 9 is a perspective view schematically illustrating a configuration of an on-vehicle antenna device on which an integrated antenna can be mounted.

DESCRIPTION OF EMBODIMENTS

The following description will discuss, with reference to the drawings, an integrated antenna in accordance with the present embodiment.

[Configuration of Loop Antenna]

Figure 1:
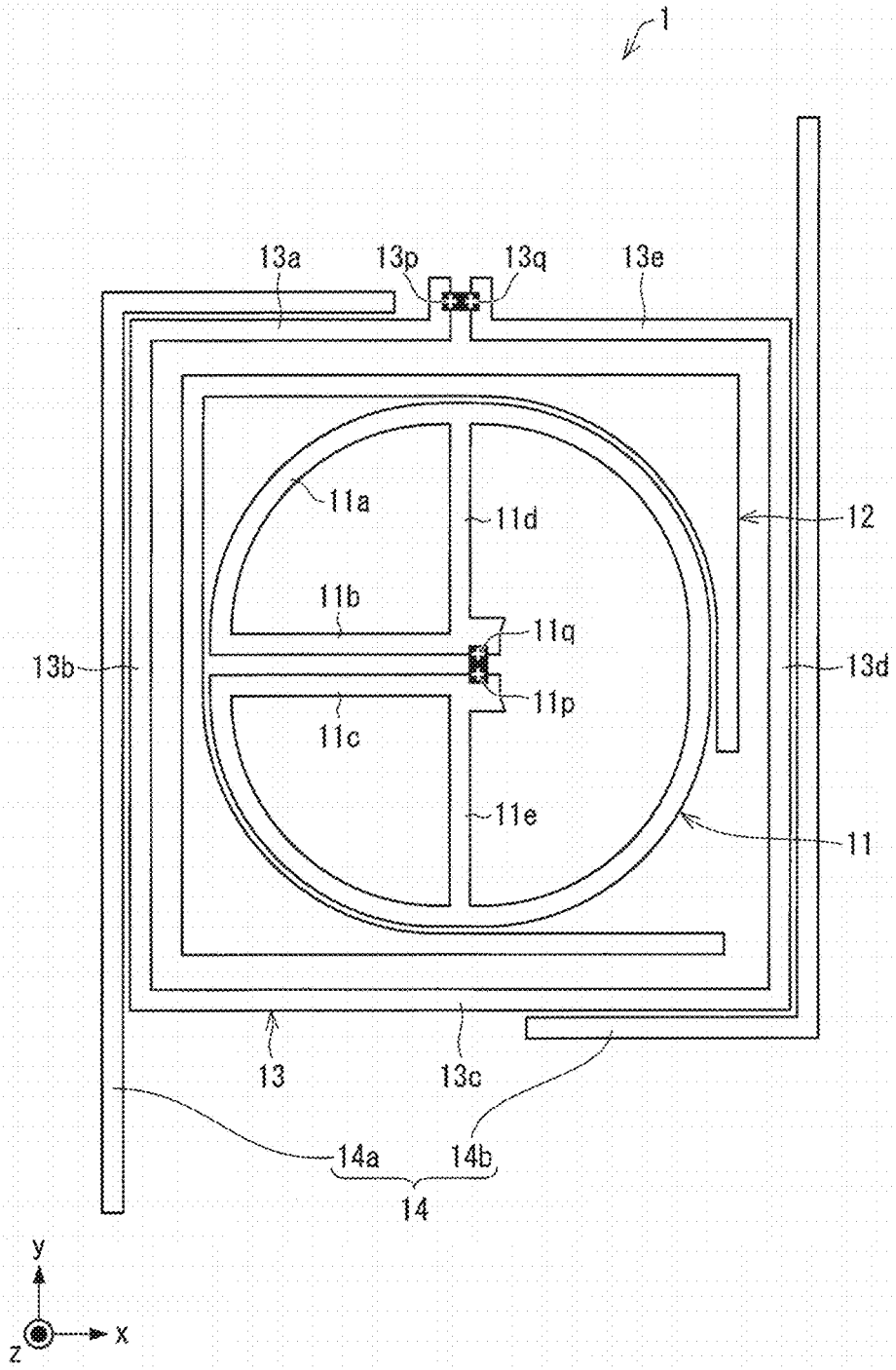
FIG. 1 is a plan view illustrating a configuration of an integrated antenna in accordance with an embodiment of the present invention.

A configuration of an integrated antenna 1 in accordance with the present embodiment will be described below with referent to FIG. 1. FIG. 1 is a plan view illustrating a configuration of the integrated antenna 1.

As illustrated in FIG. 1, the integrated antenna 1 includes a first loop antenna 11, a first passive element 12, a second loop antenna 13, and a second passive element 14. In the present embodiment, each of the first loop antenna 11, the first passive element 12, the second loop antenna 13, and the second passive element 14 is made up of an electrically conductive foil (for example, copper foil) and is provided on a surface (identical surface) of a dielectric film (not illustrated).

The first loop antenna 11 has a first annular antenna element 11*a*. In the present embodiment, a strip-shaped electric conductor which extends along a circle (can alternatively extend along an ellipse) is employed as the first annular antenna element 11*a*. The first annular antenna element 11*a* forms an open loop which is open in a direction of 9 o'clock (minus direction of an x axis) with respect to the center of the circle. That is, ends of the first annular antenna element 11*a* face each other in the direction of 9 o'clock with respect to the center of the circle.

In the present embodiment, the first loop antenna 11 further has a first feed path 11*b*, a second feed path 11*c*, a first short-circuit part 11*d*, and a second short-circuit part 11*e*.

The first feed path 11*b* is made up of a strip-shaped electric conductor which extends, substantially toward the center of the circle, from one of the ends of the first annular antenna element 11*a* (which one is located on a plus direction side of a y axis relative to the other one of the ends). A first feed point 11*q*, to which a coaxial cable (for example, an inner electric conductor of the coaxial cable) is connected, is provided at an end of the first feed path 11*b* which end is located on a center side.

The second feed path 11*c* is made up of a strip-shaped electric conductor which extends, substantially toward the center of the circle, from the other one of the ends of the first annular antenna element 11*a* (which other one is located on a minus direction side of the y axis relative to the one of the ends). A second feed point 11*p*, to which the coaxial cable (for example, an outer electric conductor of the coaxial cable) is connected, is provided at an end of the second feed path 11*c* which end is located on the center side.

The first short-circuit part 11*d* is made up of a straight stripe-shaped electric conductor, and is configured such that (i) a point on the first annular antenna element 11*a*, particularly, a point located in a direction of 0 (zero) o'clock (plus direction of the y axis) with respect to the center of the circle and (ii) the end of the first feed path 11*b*, which end is located on the center side, are short-circuited.

The second short-circuit part 11*e* is made up of a straight stripe-shaped electric conductor, and is configured such that (i) a point on the first annular antenna element 11*a*, particularly, a point located in a direction of 6 o'clock (minus direction of the y axis) with respect to the center of the circle and (ii) the end of the second feed path 11*c*, which end is located on the center side, are short-circuited.

By providing the first short-circuit part 11*d* and the second short-circuit part 11*e*, a wide variety of current paths are formed on the first loop antenna 11, so that a width of an operating band of the first loop antenna 11 is increased.

The first loop antenna 11 is provided so as to be adjacent to the first passive element 12. In the present embodiment, the first passive element 12 is made up of a single electric conductor, and is arranged on an outer side of the first loop antenna 11 (inner side of the second loop antenna 13). An inner circumference of the first passive element 12 faces (that is, the inner circumference of the first passive element 12 is capacitive-coupled with), in a direction between 0 (zero) o'clock and 3 o'clock and a direction between 6 o'clock and 9 o'clock with respect to the center of the circle, an outer circumference of the first annular antenna element 11*a*.

The second loop antenna 13 has a second annular antenna element arranged, on a plane surface identical to that where the first annular antenna element 11*a* is arranged, so as to surround the first annular antenna element 11*a* (since the second loop antenna 13 has only the second annular antenna element as a component, the second annular antenna element will be also given a reference sign "13"). In the present embodiment, a strip-shaped electric conductor which extends along a square (can alternatively extend along a rectangle) is employed as the second annular antenna element 13. The second annular antenna element 13 forms an open loop which is open in a direction of 0 (zero) o'clock with respect to the center of the square. That is, ends of the second annular antenna element 13 face each other in the direction of 0 (zero) o'clock with respect to the center of the square.

In other words, the second annular antenna element 13 is made up of (1) a first straight part 13*a* which extends in the minus direction of the x axis, (2) a second straight part 13*b* which extends in the minus direction of the y axis from a terminal end of the first straight part 13*a*, (3) a third straight part 13*c* which extends in a plus direction of the x axis from a terminal end of the second straight part 13*b*, (4) a fourth straight part 13*d* which extends in the plus direction of the y axis from a terminal end of the third straight part 13*c*, and (5) a fifth straight part 13*e* which extends in the minus direction of the x axis from a terminal end of the fourth straight part 13*d*. The first straight part 13*a* and the fifth straight part 13*e* are arranged on an identical straight line. A starting end of the first straight part 13*a* faces a terminal end of the fifth straight part 13*e*.

A first feed point 13*p*, to which a coaxial cable (for example, an inner electric conductor of the coaxial cable) is connected, is provided at one of the ends of the second annular antenna element 13 (which one is located on a minus direction side of the x axis relative to the other one of the ends). Meanwhile, a second feed point 13*q*, to which the coaxial cable (for example, an outer electric conductor of the coaxial cable) is connected, is provided at the other one of the ends of the second annular antenna element 13 (which other one is located on a plus direction side of the x axis relative to the one of the ends).

The second loop antenna 13 is provided so as to be adjacent to the second passive element 14. In the present embodiment, the second passive element 14 is made up of a first electric conductor 14*a* and a second electric conductor 14*b* each of which is arranged an outer side of the second annular antenna element 13. An inner circumference of the first electric conductor 14*a* faces (that is, the inner circumference of the first electric conductor 14*a* is capacitive-coupled with) outer circumferences of the first straight part 13*a* and the second straight part 13*b*, out of the straight parts constituting the second annular antenna element 13. An inner circumference of the second electric conductor 14*b* faces (that is, the inner circumference of the second electric conductor 14*b* is capacitive-coupled with) (i) an outer circumference of (part of) the third straight part 13*c* and (ii) an outer circumference of the fourth straight part 13*d*, out of the straight parts constituting the second annular antenna element 13.

The first loop antenna 11 can be employed as an SDARS antenna which has a resonance frequency in an SDARS band (not less than 2320 MHz and not more than 2345 MHz). In this case, the first loop antenna 11 can be arranged in a square region of approximately 42 mm×42 mm.

The second loop antenna 13 can be employed as a GPS antenna which has a resonance frequency in a GPS band (1575.42±1 (one) MHz). In this case, the second loop antenna 13 can be arranged in a square region of approximately 54 mm×54 mm.

[Characteristics of Integrated Antenna]

Next, characteristics of the integrated antenna 1, which characteristics have been revealed by the inventors carrying out simulations, will be described below with reference to FIGS. 2 and 3.

(a) of FIG. 2 is a perspective view illustrating current distribution formed in a case where a high-frequency current of 2.35 GHz is applied to the first and second feed points 11*p* and 11*q*.

In a case where the high-frequency current of 2.35 GHz is applied the first and second feed points 11*p* and 11*q*, strong current distribution is formed in the first loop antenna 11 (see (a) of FIG. 2). It is understood from such distribution that the first loop antenna has a resonance frequency in the SDARS band, that is, functions as an SDARS antenna.

Note that, in a case where the high-frequency current of 2.35 GHz is applied to the first and second feed points 11*p* and 11*q*, current distribution formed in the second loop antenna 13 is sufficiently weak (see (a) of FIG. 2). This means that, in causing the first loop antenna 11 to function as an SDARS antenna, the second loop antenna 13 has a sufficiently small effect.

(b) of FIG. 2 is a perspective view illustrating current distribution formed in a case where a high-frequency current of 1.575 GHz is applied to the first and second feed points 13*p* and 13*q*.

In a case where the high-frequency current of 1.575 GHz is applied to the first and second feed points 13*p* and 13*q*, strong current distribution is formed in the second loop antenna 13 (see (b) of FIG. 2). It is understood from such distribution that the second loop antenna has a resonance frequency in the GPS band, that is, functions as a GPS antenna.

Note that, in a case where the high-frequency current of 1.575 GHz is applied to the first and second feed points 13*p* and 13*q*, current distribution formed in the first loop antenna 11 is sufficiently weak (see (b) of FIG. 2). This means that, in causing the second loop antenna 13 to function as a GPS antenna, the first loop antenna 11 has a sufficiently small effect.

(a) of FIG. 3 is a graph illustrating a VSWR characteristic of the first loop antenna 11. In the graph illustrated in (a) of FIG. 3, a plot shown by block circles indicates the VSWR characteristic of the first loop antenna 11 which is integrated with the second loop antenna 13. A plot shown by white triangles indicates the VSWR characteristic of the first loop antenna 11 which is not integrated with the second loop antenna 13.

It is understood from (a) of FIG. 3 that a VSWR value of the first loop antenna 11 is not more than 4 in the SDARS band, irrespective of whether or not the first loop antenna 11 is integrated with the second loop antenna 13. That is, it is understood from (a) of FIG. 3 that the operating band of the first loop antenna 11 corresponds to the SDARS band and that the first loop antenna 11 does not lose this characteristic even in a case where the first loop antenna 11 is integrated with the second loop antenna 13.

(b) of FIG. 3 is a graph illustrating a VSWR characteristic of the second loop antenna 13. In the graph illustrated in (b) of FIG. 3, a plot shown by block circles indicates the VSWR characteristic of the second loop antenna 13 which is integrated with the first loop antenna 11. A plot shown by white triangles indicates the VSWR characteristic of the second loop antenna 13 which is not integrated with the first loop antenna 11.

It is understood from (b) of FIG. 3 that a VSWR value of the second loop antenna 13 is not more than 3 in the SDARS band, irrespective of whether or not the second loop antenna 13 is integrated with the first loop antenna 11. That is, it is understood from (b) of FIG. 3 that an operating band of the second loop antenna 13 corresponds to the GPS band and that the second loop antenna 13 does not lose this characteristic even in a case where the second loop antenna 13 is integrated with the first loop antenna 11.

Next, the characteristics of the integrated antenna 1, which characteristics have been revealed by the inventors carrying out an experiment, will be described below with reference to FIGS. 4 and 5.

FIG. 4 is a picture of an integrated antenna 1 used in the experiment. As illustrated in FIG. 4, the integrated antenna 1 used in the experiment is configured in the exactly same manner as the integrated antenna 1 illustrated in FIG. 1.

(a) of FIG. 5 is a graph illustrating (i) a VSWR characteristic of a first loop antenna 11 (shown as "SDARS" in (a) of FIG. 5) and (ii) a VSWR characteristic of a second loop antenna 13 (shown as "GPS" in (a) of FIG. 5). This graph is obtained by carrying out the experiment in a state where the first loop antenna 1 and the second loop antenna 13 are integrated with each other.

It is understood from (a) of FIG. 5 that (1) a VSWR value of the first loop antenna 11 is actually not more than 3 in the SDARS band and (2) a VSWR value of the second loop antenna 13 is actually not more than 4 in the GPS band.

(b) of FIG. 5 is a graph illustrating directional dependence of radiant gain, on a yz plane (see FIG. 1), of a circularly polarized wave of the second loop antenna 13. In (b) of FIG. 5, θ indicates an angle formed with respect to a plus direction of a z axis (see FIG. 1), and a unit of the radiant gain of the circularly polarized wave is dBic.

It is understood from (b) of FIG. 5 that the radiant gain of the circularly polarized wave of the second loop antenna 13 is sufficiently high in almost every direction (high enough to put the second loop antenna 13 to practical use).

(c) of FIG. 5 is a graph illustrating directional dependence of radiant gain, on the yz plane (see FIG. 1), of a circularly polarized wave of the first loop antenna 11. In (c) of FIG. 5, θ indicates an angle formed with respect to the plus direction of the z axis (see FIG. 1), and a unit of the radiant gain of the circularly polarized wave is dBic.

It is understood from (c) of FIG. 5 that the radiant gain of the circularly polarized wave of the first loop antenna 11 is sufficiently high in every direction (high enough to put the first loop antenna 11 to practical use).

[Effect of Integration]

As has been described, the operating band of the first loop antenna 11 corresponds to the SDARS band, and the first loop antenna 11 does not lose this characteristic even in a case where the first loop antenna 11 is integrated with the second loop antenna 13. Meanwhile, the operating band of the second loop antenna 13 corresponds to the GPS band, and the second loop antenna 13 does not lose this characteristic even in a case where the second loop antenna 13 is integrated with the first loop antenna 11.

However, this does not deny that (i) existence of the first loop antenna 11 affects the characteristic of the second loop antenna 13 and (ii) existence of the second loop antenna 13 affects the characteristic of the first loop antenna 11. Indeed, an axial ratio of the first loop antenna 11 is improved by integrating the first loop antenna 11 with the second loop antenna 13. That is, by combining the first loop antenna 11 with the second loop antenna 13 as illustrated in FIG. 1, a new effect is brought about such that the axial ratio of the first loop antenna 11 is improved.

This point will be described below with reference to FIG. 6.

(a) and (b) of FIG. 6 are graphs each illustrating directional dependence of radiant gain of a circularly polarized wave of the first loop antenna 11 at 2340 MHz which gain is obtained in a state where the first loop antenna 11 is integrated with the second loop antenna 13. In particular, (a) of FIG. 6 illustrates gain, on a zx plane (see FIG. 1), of a left-handed circularly polarized wave (LHCP) and of a right-handed circularly polarized wave (RHCP). (b) of FIG. 6 illustrates gain, on a yz plane (see FIG. 1), of a left-handed circularly polarized wave (LHCP) and of a right-handed circularly polarized wave (RHCP).

On the other hand, (c) and (d) of FIG. 6 are graphs each illustrating the directional dependence of the radiant gain of the circularly polarized wave of the first loop antenna 11 at 2340 MHz which gain is obtained in a state where the first loop antenna 11 is not integrated with the second loop antenna 13. In particular, (c) of FIG. 6 illustrates the gain, on the zx plane (see FIG. 1), of the left-handed circularly polarized wave (LHCP) and of the right-handed circularly polarized wave (RHCP). (d) of FIG. 6 illustrates the gain, on the yz plane (see FIG. 1), of the left-handed circularly polarized wave (LHCP) and of the right-handed circularly polarized wave (RHCP).

In regard to the radiant gain, on the zx plane, of the circularly polarized wave of the first loop antenna 11, it is understood from comparison between the graph illustrated in (a) of FIG. 6 and the graph illustrated in (c) of FIG. 6 that, by integrating the first loop antenna 11 with the second loop antenna 13, the radiant gain of the right-handed circularly polarized wave can be lowered while the radiant gain of the left-handed circularly polarized wave is kept substantially constant. That is, in regard to the radiant gain, on the zx plane, of the circularly polarized wave of the first loop antenna 11, it is understood that the axial ratio of the first loop antenna 11 is improved by integrating the first loop antenna 11 with the second loop antenna 13.

Meanwhile, in regard to the radiant gain, on the yz plane, of the circularly polarized wave of the first loop antenna 11, it is understood from comparison between the graph illustrated in (b) of FIG. 6 and the graph illustrated in (d) of FIG. 6 that, by integrating the first loop antenna 11 with the second loop antenna 13, the radiant gain of the right-handed circularly polarized wave can be lowered while the radiant gain of the left-handed circularly polarized wave is kept substantially constant. That is, in regard to the radiant gain, on the yz plane, of the circularly polarized wave of the first loop antenna 11, it is understood that the axial ratio of the first loop antenna 11 is improved by integrating the first loop antenna 11 with the second loop antenna 13.

It is considered that the reason why the axial ratio of the first loop antenna 11 is thus improved is that the second loop antenna 13 functions as a passive element for the first loop antenna 11 and, as a result, a phase difference between a longitudinal current and a lateral current in the first loop antenna 11 is adjusted.

[Adjustment of Resonance Frequency]

According to the integrated antenna 1, the first passive element 12 is provided between the antenna element of the first loop antenna 11 and the antenna element of the second loop antenna 13. Therefore, even in a case where a shape, on an inner circumference side and/or an outer circumference side, of the antenna element of the first loop antenna 11 is changed so as to adjust the resonance frequency of the first loop antenna 11, there is no concern that such a change in shape affects the resonance frequency of the second loop antenna 13. Similarly, even in a case where a shape, on an outer circumference side, of the antenna element of the second loop antenna 13 is changed so as to adjust the resonance frequency of the second loop antenna 13, there is no concern that such a change in shape affects the resonance frequency of the first loop antenna 11. Therefore, the integrated antenna 1 brings about a merit in manufacturing such that it is possible to individually adjust the resonance frequency of the first loop antenna 11 and the resonance frequency of the second loop antenna 13. This point will be described below with reference to FIG. 7.

FIG. 7 is a plan view illustrating a configuration of an integrated antenna 1 in accordance with Example of the present invention. (a) of FIG. 7 illustrates the configuration of the integrated antenna 1 in which no change was made. According to the integrated antenna 1 illustrated in (a) of FIG. 7, a resonance frequency of a first loop antenna 11 was 1.90 GHz, whereas a resonance frequency of a second loop antenna 13 was 1.96 GHz.

(b) of FIG. 7 illustrates the configuration of the integrated antenna 1 in which a shape, on an inner circumference side, of the first loop antenna 11 was changed. Specifically, as illustrated in (b) of FIG. 7, a change was made in shape by adding an electric conductor 11*f* to an inner circumference side of an antenna element of the first loop antenna 11. According to the integrated antenna 1 illustrated in (b) of FIG. 7, the resonance frequency of the first loop antenna 11 was 2.11 GHz, whereas the resonance frequency of the second loop antenna 13 was 1.96 GHz. That is, it was found that, even in a case where the resonance frequency of the first loop antenna 11 was changed by making such a change, the resonance frequency of the second loop antenna 13 did not change.

(c) of FIG. 7 illustrates the configuration of the integrated antenna 1 in which the shape, on the inner circumference side and an outer circumference side, of the first loop antenna 11 was changed. Specifically, as illustrated in (c) of FIG. 7, a change was made in shape by adding the electric conductor 11*f* to the antenna element of the first loop antenna 11 so that part of the electric conductor 11*f* projects out from an outer circumference side of the antenna element. According to the integrated antenna 1 illustrated in (c) of FIG. 7, the resonance frequency of the first loop antenna 11 was 1.69 GHz, whereas the resonance frequency of the second loop antenna 13 was 1.96 GHz. That is, it was found that, even in a case where the resonance frequency of the first loop antenna 11 was changed by making such a change, the resonance frequency of the second loop antenna 13 did not change.

(d) of FIG. 7 illustrates the configuration of the integrated antenna 1 in which a shape, on an outer circumference side, of the second loop antenna 13 was changed. Specifically, as illustrated in (d) of FIG. 7, a change was made in shape by adding electric conductors 13*f* and 13*g* to an outer circumference side of an antenna element of the second loop antenna 13. According to the integrated antenna 1 illustrated in (d) of FIG. 7, the resonance frequency of the second loop antenna 13 was 1.82 GHz, whereas the resonance frequency of the first loop antenna 11 was 1.90 GHz. That is, it was found that, even in a case where the resonance frequency of the second loop antenna 13 was changed by making such a change, the resonance frequency of the first loop antenna 11 did not change.

Even in a case where no first passive element 12 is provided between the antenna element of the first loop antenna 11 and the antenna element of the second loop antenna 13, it is possible to achieve the following effect. That is, even in a case where the inner circumference side of the antenna element of the first loop antenna 11 is changed in shape so as to adjust the resonance frequency of the first loop antenna 11, this does not affect the resonance frequency of the second loop antenna 13. This point will be described below with reference to FIG. 8.

FIG. 8 is a plan view illustrating a configuration of an integrated antenna 1 in accordance with Example of the present invention. (a) of FIG. 8 illustrates the configuration of the integrated antenna 1 in which no change was made. The integrated antenna 1 illustrated in FIG. 8 was identical in configuration to the integrated antenna 1 illustrated in FIG. 7, except that the integrated antenna 1 illustrated in FIG. 8 included no first passive element 12 and no second passive element 14. According to the integrated antenna 1 illustrated in (a) of FIG. 8, a resonance frequency of a first loop antenna 11 was 1.50 GHz, whereas a resonance frequency of a second loop antenna 13 was 1.30 GHz.

(b) of FIG. 8 illustrates the configuration of the integrated antenna 1 in which a shape, on an inner circumference side, of the first loop antenna 11 was changed. Specifically, as illustrated in (b) of FIG. 8, a change was made in shape by adding electric conductors 11*f*, 11*g*, and 11*h* to an inner circumference side of an antenna element of the first loop antenna 11. According to the integrated antenna 1 illustrated in (b) of FIG. 8, the resonance frequency of the first loop antenna 11 was 0.79 GHz, whereas the resonance frequency of the second loop antenna 13 was 1.30 GHz. That is, it was found that, even in a case where the resonance frequency of the first loop antenna 11 was changed by making such a change, the resonance frequency of the second loop antenna 13 did not change.

[Antenna Device]

The integrated antenna 1 is suitably mounted on an on-vehicle antenna device. Such an antenna device 2 will be described below with reference to FIG. 9. FIG. 9 is a perspective view schematically illustrating a configuration of the antenna device 2.

As illustrated in FIG. 9, the antenna device 2 includes a base 21, a spacer 22, and a radome 23. Note that, in order to clarify an inner structure of the antenna device 2, FIG. 9 illustrates the antenna device 2 in a state where the radome 23 is removed.

The base 21 is a plate member whose upper and lower surfaces each have a square shape, and is made of metal such as aluminum. In a case where the antenna device 2 is mounted on a vehicle, the base 21 is arranged on a roof of the vehicle so that a diagonal line of the base 21 is parallel to a travelling direction of the vehicle.

The spacer 22 is placed on the upper surface of the base 21. The spacer 22 is, for example, a columnar member made of resin, and is configured to cause the base 21 to be apart from an antenna.

On an upper surface of the spacer 22, three areas A1, A2, an A3 are provided to each of which an antenna is attached. The integrated antenna 1 is attached to the area A1 which has a square shape and which is provided in the center of the upper surface of the spacer 22.

The radome 23 is, for example, a ship-bottom-shaped member made of resin, and is configured to cover the spacer 22 to whose upper surface an antenna is attached. The antenna, housed in an enclosed space formed by the base 21 and the radome 23, is not exposed to rain water.

The area A of the antenna device 2, to which area A the integrated antenna 1 is attached, is arranged so that a diagonal line of the area A is parallel to the travelling direction of the vehicle, that is, the diagonal line of the area A is parallel to the diagonal line of the upper surface of the base 21. This allows the antenna device 2 to have a streamline-shape in which a front part of the antenna device 2 is sharp, without unnecessarily increasing a size of the antenna device 2.

Note that an antenna, other than the integrated antenna 1, such as an antenna for DAB or an antenna for LTE can be mounted on the antenna device 2. Each of the areas A2 and A3, each having an L-shape and provided on the upper surface of the spacer 22, is an area to which such an antenna is attached. Examples of the antenna, other than the integrated antenna 1, which is suitably mounted on the antenna device 2 encompass a monopole antenna and an inverted F antenna.

In this case, the antenna to be attached to the area A2 can be attached, in part, to a side surface S1 and/or a side surface S2 of the spacer 22. Similarly, the antenna to be attached to the area A3 can be attached, in part, to a side surface S3 and/or a side surface S4 of the spacer 22. Further, in a case where the base 21 is made of metal, the base 21 can be used as a ground plane.

[Supplementary Note]

The foregoing embodiment has described a configuration such that the first passive element 12 is arranged on the outer side of the first annular antenna element 11*a* (between the first annular antenna element 11*a* and the second annular antenna element 13). However, the present invention is not limited to such a configuration. That is, the first passive element 12 can be alternatively arranged on an inner side of the first annular antenna element 11*a*.

Furthermore, the foregoing embodiment has described a configuration such that the second passive element 14 is arranged on the outer side of the second annular antenna element 13. However, the present invention is not limited to such a configuration. That is, the second passive element 14 can be alternatively arranged on the inner side of the second annular antenna element 13 (between the first annular antenna element 11*a* and the second annular antenna element 13).

[Summary]

As has been described, an integrated antenna in accordance with the present embodiment includes: a first loop antenna having a first annular antenna element; and a second loop antenna having a second annular antenna element, the second loop antenna being lower in resonance frequency than the first loop antenna, the second annular antenna element being arranged, on an surface identical to that where the first annular antenna element is arranged, so as to surround the first annular antenna element.

According to the above configuration, the second annular antenna element is arranged so as to surround the first annular antenna element. Therefore, it is possible to avoid a problem with a configuration in which two loop antennas are arranged side by side. That is, it is possible to avoid a problem that the integrated antenna is increased in side in a horizontal direction of the integrated antenna. Furthermore, according to the above configuration, the first annular antenna element and the second annular antenna element are arranged on an identical surface. Therefore, it is possible to avoid problems with a configuration in which two loop antennas are layered. That is, it is possible to avoid (i) a problem that the integrated antenna is increased in size in a vertical direction of the integrated antenna and (ii) a problem that a characteristic of one of the two loop antennas, which one is provided on a lower side, is deteriorated. Namely, according the above configuration, it is possible to realize an integrated antenna which is smaller in size than a conventional integrated antenna, without causing a deterioration in characteristic of each loop antenna.

Moreover, it has been revealed from the experiment carried out by the inventors that an axial ratio of the first loop antenna is improved by arranging the second annular antenna element so as to surround the first annular antenna element. That is, according to the above configuration, it is possible to achieve not only a passive effect that the characteristic of each loop antenna is not deteriorated, but also an active effect that the axial ratio of the first loop antenna is improved.

The integrated antenna in accordance with the present embodiment is preferably arranged so as to further include a first passive element arranged between the first annular antenna element and the second annular antenna element, at least part of an inner circumference of the first passive element facing at least part of an outer circumference of the first annular antenna element.

According to the above configuration, it is possible to cause the first loop antenna to function as an antenna suitable to receive a circularly polarized wave such as an SDARS wave, due to action of the first passive element. Besides, since the first passive element is arranged on an outer side of the first annular antenna element, it is possible to add, to an inner side of the first annular antenna element, a configuration such as a feed path and a short-circuit part.

Furthermore, according to the above configuration, the first passive element is provided between the second annular antenna element and the first annular antenna element. Therefore, even in a case where a shape of the first annular antenna element is changed so as to adjust the resonance frequency of the first loop antenna, the resonance frequency of the second loop antenna does not change considerably. Meanwhile, even in a case where a shape of the second annular antenna element is changed so as to adjust the resonance frequency of the second loop antenna, the resonance frequency of the first loop antenna does not change considerably. Therefore, according to the above configuration, it is possible to realize an integrated antenna which allows the resonance frequency of the first loop antenna and the resonance frequency of the second loop antenna to be individually (that is, easily) adjusted.

The integrated antenna in accordance with the present embodiment is preferably arranged such that the first loop antenna further has: first and second feed paths extending, toward a center of a region surrounded by the first annular antenna element, from respective ends of the first annular antenna element which ends face each other; a first short-circuit part configured such that (i) an end of the first feed path which end is located on a center side and (ii) a first point on the first annular antenna element are short-circuited; and a second short-circuit part configured such that an end of the second feed path which end is located on the center side and (ii) a second point on the first annular antenna element are short-circuited.

According to the above configuration, it is possible to connect a coaxial cable to the ends of the respective first and second feed paths which ends are each located on the center side. Therefore, it is possible to avoid a problem caused in a case where a coaxial cable is connected to the ends of the first annular antenna element. That is, it is possible to avoid a problem that a characteristic of the first loop antenna is deteriorated because the coaxial cable passes by the first annular antenna element.

Moreover, according to the above configuration, by providing the first and second short-circuit parts, a wide variety of current paths are formed on the first loop antenna. As a result, it is possible to increase a width of an operating band (band in which a VSRW value is not more than a predetermined threshold) of the first loop antenna.

The integrated antenna in accordance with the present embodiment is preferably arranged so as to further include a second passive element arranged on an outer side of the second annular antenna element, at least part of an inner circumference of the second passive element facing at least part of an outer circumference of the second annular antenna element.

According to the above configuration, it is possible to cause the second loop antenna to function as an antenna suitable to receive a circularly polarized wave such as a GPS wave, due to action of the second passive element.

As has been described, according to the integrated antenna in accordance with the present embodiment, it is possible to realize an integrated antenna which is smaller in size than a conventional integrated antenna, without causing a deterioration in characteristic of each loop antenna.

A method of manufacturing the integrated antenna in accordance with the present embodiment includes the step of: changing a shape of the first annular antenna element so as to adjust the resonance frequency of the first loop antenna.

According to the integrated antenna, the first passive element is provided between the second annular antenna element and the first annular antenna element. Therefore, even in a case where the step of changing the shape of the first annular antenna element is carried out so as to adjust the resonance frequency of the first loop antenna, the resonance frequency of the second loop antenna hardly changes. Thus, according to the above configuration, it is possible to individually (that is, easily) adjust the resonance frequency of the first loop antenna and the resonance of the second loop antenna.

A method of manufacturing the integrated antenna in accordance with the present embodiment includes the step of: changing a shape, on an inner circumference side, of the first annular antenna element so as to adjust the resonance frequency of the first loop antenna.

According to the integrated antenna, even in a case where the step of changing the shape, on the inner circumference side, of the first annular antenna element is carried out so as to adjust the resonance frequency of the first loop antenna, the resonance frequency of the second loop antenna hardly changes. Thus, according to the above configuration, it is possible to adjust the resonance frequency of the first loop antenna, separately from the resonance of the second loop antenna. That is, it is possible to easily adjust the resonance frequency of the first loop antenna.

[Supplementary Note 2]

Although the embodiments of the present invention have been described, the present invention is not limited to the embodiments, but may be altered by a skilled person in the art within the scope of the claims. An embodiment derived from a proper combination of technical means disclosed in different embodiments is also encompassed in the technical scope of the present invention.

INDUSTRIAL APPLICABILITY

The present invention is widely applicable to integrate antennas which operate in two or more different frequency bands. For example, the present invention is suitably employed as an on-vehicle antenna mounted on a vehicle such as a car.

REFERENCE SIGNS LIST

1 Integrated antenna
11 First loop antenna
11*a* First annular antenna element
11*b* and 11*c* Feed path
11*d* and 11*e* Short-circuit part
12 First passive element
13 Second loop antenna, Second annular antenna element
13*a* through 13*e* Straight part
14 Second passive element

The invention claimed is:

1. An integrated antenna comprising:

a first loop antenna having a first annular antenna element;

a second loop antenna having a second annular antenna element, the second loop antenna being lower in resonance frequency than the first loop antenna, the second annular antenna element being arranged, on a surface identical to that where the first annular antenna element is arranged, so as to surround the first annular antenna element; and a first passive element arranged between the first annular antenna element and the second annular antenna element, at least part of an inner circumference of the first passive element facing at least part of an outer circumference of the first annular antenna element, the first loop antenna further having:

first and second feed paths extending, toward a center of a region surrounded by the first annular antenna element, from respective ends of the first annular antenna element which ends face each other;

a first short-circuit part configured such that (i) an end of the first feed path which end is located on a center side and (ii) a first point on the first annular antenna element are short-circuited; and a second short-circuit part configured such that (i) an end of the second feed path which end is located on the center side and (ii) a second point on the first annular antenna element are short-circuited.

2. The integrated antenna as set forth in claim 1, wherein: the inner circumference of the first passive element faces (i) a first part of the outer circumference of the first annular antenna element, the first part ranging from an intersection point of the first annular antenna element and the second feed path to an intersection point of the first annular antenna element and the second short-circuit part and (ii) a second part of the outer circumference of the first annular antenna element, the second part being located across the first annular antenna element from the first part.

3. The integrated antenna as set forth in claim 1, wherein:

the first annular antenna element forms an open loop which is open in a direction of 9 o'clock with respect to the center;

the ends of the first annular antenna element are located in the direction of 9 o'clock with respect to the center;

the second point is located in a direction of 6 o'clock with respect to the center; and the inner circumference of the first passive element faces, in a direction between 0 (zero) o'clock and 3 o'clock and a direction between 6 o'clock and 9 o'clock with respect to the center, the outer circumference of the first annular antenna element.

4. The integrated antenna as set forth in claim 1, further comprising:

a second passive element arranged on an outer side of the second annular antenna element, at least part of an inner circumference of the second passive element facing at least part of an outer circumference of the second annular antenna element.

5. A method of manufacturing the integrated antenna recited in claim 1, comprising the step of:

changing a shape of the first annular antenna element so as to adjust the resonance frequency of the first loop antenna.

6. A method of manufacturing the integrated antenna recited in claim 1, comprising the step of:

changing a shape, on an inner circumference side, of the first annular antenna element so as to adjust the resonance frequency of the first loop antenna.

7. The integrated antenna as set forth in claim 1, wherein the first passive element is disposed on the surface identical to that where the first annular antenna element is arranged.

* * * * *